US007195702B2

(12) United States Patent
Bokisa, Sr. et al.

(10) Patent No.: US 7,195,702 B2
(45) Date of Patent: Mar. 27, 2007

(54) TIN ALLOY ELECTROPLATING SYSTEM

(75) Inventors: George S. Bokisa, Sr., North Olmsted, OH (US); William E. Eckles, Cleveland Hts., OH (US); Robert E. Frischauf, Lakewood, OH (US)

(73) Assignee: Taskem, Inc., Brooklyn Heights, OH (US)

( * ) Notice: Subject to any disclaimer, the term of this patent is extended or adjusted under 35 U.S.C. 154(b) by 270 days.

(21) Appl. No.: 10/456,714

(22) Filed: Jun. 6, 2003

(65) Prior Publication Data

US 2004/0245113 A1 Dec. 9, 2004

(51) Int. Cl.
*C25D 3/30* (2006.01)
*C25D 3/32* (2006.01)
*C25D 17/00* (2006.01)

(52) U.S. Cl. ..... 205/254; 204/252; 205/252; 205/253

(58) Field of Classification Search ..... 204/252, 204/263; 205/241, 238, 242, 252, 239, 240
See application file for complete search history.

(56) References Cited

U.S. PATENT DOCUMENTS

| | | | | |
|---|---|---|---|---|
| 4,111,772 | A | 9/1978 | Horn | |
| 4,330,377 | A | 5/1982 | Franks, Jr. | |
| 4,459,185 | A * | 7/1984 | Obata et al. | 205/254 |
| 4,565,609 | A * | 1/1986 | Nobel et al. | 205/254 |
| 4,828,657 | A * | 5/1989 | Fukuoka et al. | 205/254 |
| 4,944,851 | A * | 7/1990 | Cordani et al. | 205/575 |
| 5,039,576 | A * | 8/1991 | Wilson | 428/626 |
| 5,194,141 | A | 3/1993 | Suganuma et al. | |
| 5,312,539 | A | 5/1994 | Thomson | |
| 5,403,460 | A * | 4/1995 | Sala et al. | 204/252 |
| 5,785,833 | A | 7/1998 | Vaughan | |
| 5,883,762 | A * | 3/1999 | Calhoun et al. | 204/119 |
| 6,063,172 | A * | 5/2000 | Bokisa et al. | 428/577 |
| 6,120,673 | A | 9/2000 | Reiter et al. | |
| 6,251,255 | B1 | 6/2001 | Copping et al. | |
| 6,527,920 | B1 * | 3/2003 | Mayer et al. | 204/237 |

FOREIGN PATENT DOCUMENTS

| | | |
|---|---|---|
| EP | 0048579 | 3/1982 |
| EP | 0048579 A1 * | 3/1982 |

OTHER PUBLICATIONS

International Search Report, PCT/US04/11405, Nov. 5, 2004.

* cited by examiner

*Primary Examiner*—Harry D. Wilkins, III
(74) *Attorney, Agent, or Firm*—Amin & Turocy, LLP

(57) ABSTRACT

Disclosed are systems and methods of plating a tin alloy in an efficient, economical, and environmentally friendly manner. An electrochemical cell containing an anolyte compartment and a catholyte compartment separated by a selective membrane is employed. The selective membrane prevents ionic metals from migrating from the catholyte compartment to the anolyte compartment. A conduit may be employed in the electrochemical cell to permit one way flow of anolyte to the catholyte compartment thereby replenishing tin to the catholyte compartment.

30 Claims, 1 Drawing Sheet

TIN ALLOY ELECTROPLATING SYSTEM

FIELD OF THE INVENTION

The present invention generally relates to plating a tin alloy on a substrate. In particular, the present invention relates to systems and methods for electroplating tin alloys without the occurrence of whiskering.

BACKGROUND OF THE INVENTION

Tin plating is known. Tin has many desirable attributes as a plated finish including solderability, lubricity, good electrical conductivity, and corrosion resistance. Tin is a silver-colored, ductile metal whose major application is to impart solderability to otherwise unsolderable base metals. Tin has generally good covering characteristics over a wide range of shapes. While tin does not tarnish easily, tin is a soft, ductile finish that can scratch or mar easily. Tin is reported to be non-toxic and non-carcinogenic and thus is approved for food container and food contact applications.

Unfortunately, tin plating suffers from a significant drawback, the undesirable formation of spontaneous latent whiskers. Whiskering involves the formation of thin, needle-like crystals after plating. Whiskers typically form from a few weeks to several years after plating. Common whiskers may measure up to 2.5 μm in diameter, and can grow to a length of 10 mm. Conditions that tend to promote the growth of whiskers are compressive stresses and uniform temperatures for long periods of time. In some applications using tin plating, whiskers are not functionally noticed and therefore harmless. However, in other applications, such as closely spaced electronic circuits, whiskers undermine the operational function of devices employing a tin plating product. For example, in electronic circuitry, whiskers are capable of carrying sufficient current at low voltages to cause short circuits or a corona discharge. Whiskers can have a current carrying capacity of as high as 10 mA.

Attempts to eliminate the possibility of tin whiskering involve alloying the deposit of tin with lead. It is desirable to include more than 3% by weight lead in a tin-lead alloy to insure no latent whiskering. Many applications even call for increased lead contents towards the eutectic, thereby depressing the melting point of the alloy. Due to disposal, environmental, and health concerns, deposits that contain lead, as well as the general use of lead, are no longer desirable.

SUMMARY OF THE INVENTION

The present invention involves plating tin alloys while minimizing and/or eliminating latent whiskering. The tin alloys alleviate disposal, environmental, and health concerns since they are lead free. The tin alloy plating system permits the employment of working tin anodes without the danger of immersion plating of the alloy material thereon. In many instances, the tin alloy plating system permits plating tin alloys without the need of complexing and/or chelating agents, further alleviating disposal, environmental, and health concerns associated with metal plating systems. Since working tin anodes may be employed as a source of tin in the tin alloy plating systems, significant cost reductions are achieved compared to plating systems that use liquid based tin salts as a tin source. The resultant tin alloys formed in accordance with the present invention have desirable characteristics including one or more of lack of latent whiskering, relatively high tin content, lead free alloys, excellent solderability, excellent lubricity, excellent electrical conductivity, corrosion resistance, excellent leveling, excellent ductility, lack of pinholes, and controllable thickness.

One aspect of the invention relates to systems for plating a tin alloy. The systems contain an electrochemical cell containing an anolyte compartment and a catholyte compartment separated by a selective membrane. The anolyte compartment contains an anode and anolyte comprising water, an acid, and ionic tin. The catholyte compartment contains a cathode and catholyte comprising water, acid, an ionic alloy metal, and ionic tin. The systems further contain a conduit to permit one way flow of anolyte to the catholyte compartment.

Another aspect of the invention relates to methods of electroplating a tin alloy involving providing an electroplating bath containing an anolyte compartment and a catholyte compartment separated by a selective membrane; the catholyte compartment comprising a cathode and catholyte containing water, acid, at least one ionic alloy metal, and ionic tin; and applying a current to the electroplating bath whereby a tin alloy forms on the cathode.

Yet another aspect of the invention relates to methods of forming a lead free tin alloy involving providing an electroplating bath containing an anolyte compartment and a catholyte compartment separated by a selective membrane. The electroplating bath may further contain a conduit to permit one way flow of anolyte to the catholyte compartment, and applying a current to the electroplating bath whereby a lead free tin alloy forms on the cathode.

DETAILED DESCRIPTION OF THE INVENTION

The present invention can be employed for tin alloy electroplating. Generally speaking, electroplating involves metal in ionic form migrating in solution from a positive to a negative electrode. An electrical current passing through the solution causes substrates at the cathode to be coated by the metal (tin and alloy metal(s)) in solution. That is, in most embodiments, the substrate to be plated is the cathode.

Figure 1:
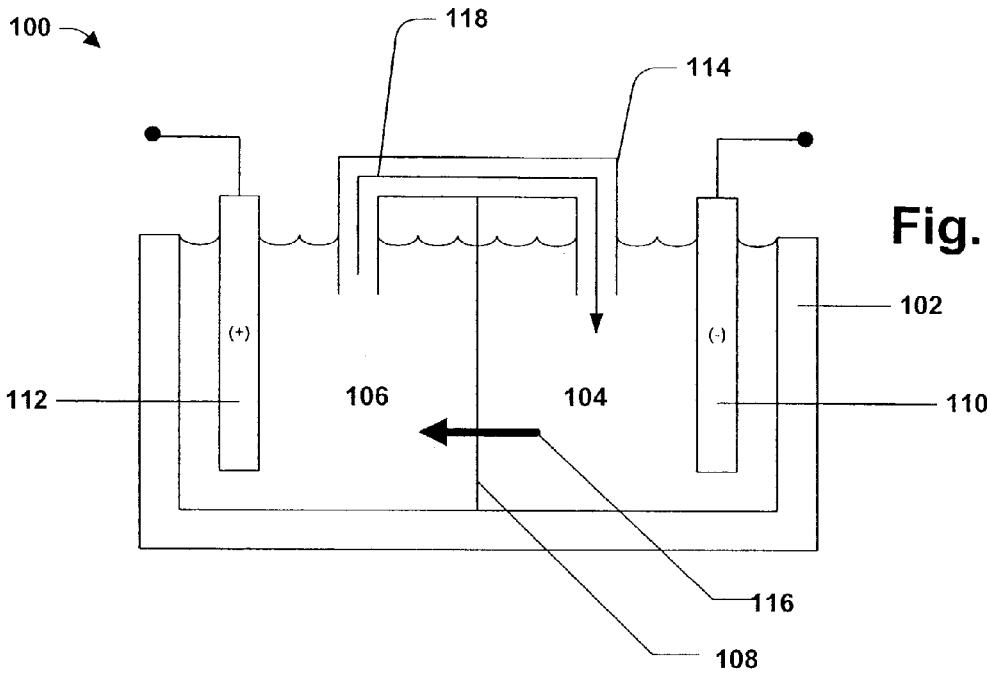
FIG. 1 illustrates a schematic diagram of a tin alloy electroplating system in accordance with one aspect of the present invention.

Referring to FIG. 1, the tin alloy plating system 100 includes a power source (not shown) for providing current to an electrochemical cell 102 containing an anolyte compartment 106 and a catholyte compartment 104 separated by a selective membrane 108 (and this general arrangement may be repeated one or more times to provide electrochemical cells with a plurality of anolyte compartments 106, catholyte compartments 104, and selective membranes 108). The anolyte compartment 106 contains an anode 112 and an aqueous anolyte and the catholyte compartment 104 contains a cathode 110 and an aqueous catholyte. The aqueous anolyte contains at least water, an acid, and ionic tin while the aqueous catholyte contains water, acid, an ionic alloy metal, and ionic tin. The electrochemical cell has a conduit 114 to permit the flow 118 of the aqueous anolyte into the catholyte compartment. Water may flow osmotically 116 from the aqueous catholyte into the anolyte compartment 106 through selective membrane 108. Plating of a tin alloy occurs at the cathode 110.

The electroplating bath or catholyte and anolyte are aqueous solutions. In this connection, the catholtye and anolyte contain water. However, the catholtye and anolyte may optionally contain one or more co-solvents. Such co-solvents include water-miscible solvents such as alcohols, glycols, alkoxy alkanols, ketones, and various other aprotic solvents. Specific examples of co-solvents include methanol, ethanol, propanol, ethylene glycol, 2-ethoxy ethanol, acetone, dimethyl formamide, dimethyl sulfoxide, acetonitrile, and the like.

In the anolyte and catholyte, tin is present in ionic form. Sources of ionic tin are typically the corresponding tin salts and the tin containing anode. Examples of tin salts include tin acetate, tin ethylhexanoate, tin sulfate, tin chloride, tin fluoride, tin iodide, tin bromide, tin methanesulfonate, tin oxide, tin tetrafluoroborate, tin trifluoromethanesulfonate, tin pyrophosphate, tin sulfide, and hydrates thereof.

The anolyte and catholyte each contain an amount of ionic tin to facilitate plating a tin alloy in the catholyte compartment. In one embodiment, the anolyte and catholyte each contain about 1 g/l or more and about 300 g/l or less of ionic tin (as $Sn^{2+}$). In another embodiment, the anolyte and catholyte each contain about 10 g/l or more and about 200 g/l or less of ionic tin. In yet another embodiment, the anolyte and catholyte each contain about 20 g/l or more and about 150 g/l or less of ionic tin.

One or more alloy metals combine with tin to form the tin alloy plating. Examples of alloy metals include bismuth, copper, silver, zinc, and indium. In one embodiment, the one or more alloy metals are more noble than tin. In the catholyte, the alloy metals are in ionic form. Examples of the ionic form of alloy metals include $Bi^{3+}$, $Cu^{2+}$, $Ag^{+}$, $Zn^{2+}$, and $In^{3+}$. Sources of ionic alloy metals are typically the corresponding salts, such as bismuth salts, copper salts, silver salts, zinc salts, and indium salts. Specific examples include bismuth chloride, bismuth fluoride, bismuth nitrate, bismuth acetate, bismuth methanesulfonate, bismuth oxychloride, bismuth citrate, copper sulfate, copper polyphosphate, copper sulfamate, copper chloride, copper formate, copper fluoride, copper nitrate, copper oxide, copper tetrafluoroborate, copper methanesulfonate, copper trifluoromethanesulfonate, copper trifluoroacetate, silver acetate, silver carbonate, silver sulfate, silver phosphate, silver chloride, silver bromide, silver fluoride, silver citrate, silver nitrate, silver methanesulfonate, silver tetrafluoroborate, silver trifluoroacetate, zinc acetate, zinc citrate, zinc sulfate, zinc chloride, zinc fluoride, zinc bromide, zinc nitrate, zinc oxide, zinc tetrafluoroborate, zinc methanesulfonate, zinc trifluoromethanesulfonate, zinc trifluoroacetate, indium acetate, indium sulfate, indium phosphide, indium chloride, indium fluoride, indium bromide, indium nitrate, indium oxide, indium methanesulfonate, indium trifluoromethanesulfonate, and hydrates thereof, The catholyte contains an amount of at least one ionic alloy metal to facilitate plating a tin alloy in the catholyte compartment. In one embodiment, the catholyte contains about 0.1 g/l or more and about 200 g/l or less of at least one ionic alloy metal. In another embodiment, the catholyte contains about 1 g/l or more and about 150 g/l or less of at least one ionic alloy metal. In yet another embodiment, the catholyte contains about 5 g/l or more and about 100 g/l or less of at least one ionic alloy metal. Owing to the presence of the ionic membrane, the anolyte comprises substantially no ionic alloy metal therein, and preferably, no ionic alloy metal therein.

The anoltye and catholyte individually contain at least one acid. The anolyte and catholyte may contain the same or different acid(s), and the anolyte and catholyte may contain the same or different number of acid(s). The acids are relatively strong acids that are not oxidizing acids. Examples of acids include sulfuric acid, trifluoroacetic acid, phosphoric acid, polyphosphoric acid, fluoboric acid, hydrochloric acid, acetic acid, alkane sulfonic acids, and alkanol sulfonic acids.

Alkane sulfonic acids are represented by Formula I:

$$RSO_3H \quad (I)$$

wherein R is an alkyl group containing from about 1 to about 12 carbon atoms. In another embodiment, R is an alkyl group containing from about 1 to about 6 carbon atoms. Examples of alkane sulfonic acids include methane sulfonic acid, ethane sulfonic acid, propane sulfonic acid, 2-propane sulfonic acid, butane sulfonic acid, 2-butane sulfonic acid, pentane sulfonic acid, hexane sulfonic acid, decane sulfonic acid and dodecane sulfonic acid.

Alkanol sulfonic acids are represented by Formula II:

$$C_nH_{2n+1}-\underset{\underset{OH}{|}}{CH}(CH_2)_mSO_3H \quad (II)$$

wherein n is from about 0 to about 10, m is from about 1 to about 11 and the sum of m+n is up to about 12. As can be seen from Formula II, the hydroxy group may be a terminal or internal hydroxy group. Examples of alkanol sulfonic acids include 2-hydroxy ethyl-1-sulfonic acid, 1-hydroxy propyl-2-sulfonic acid, 2-hydroxy propyl-1-sulfonic acid, 3-hydroxy propyl-1-sulfonic acid, 2-hydroxy butyl-1-sulfonic acid, 4-hydroxy-pentyl-1-sulfonic acid, 2-hydroxy-hexyl-1-sulfonic acid, 2-hydroxy decyl-1-sulfonic acid, and 2-hydroxy dodecyl-1-sulfonic acid. The alkane sulfonic acids and alkanol sulfonic acids are available commercially and can also be prepared by a variety of methods known in the art.

The anolyte and catholyte individually contain amounts of at least one acid to facilitate the electroplating of tin alloy. That is, the pH of the electroplating bath is maintained to promote the efficient plating of tin alloy on the cathode. In one embodiment, the pH of the anoltye and catholyte are individually about 3 or less. In another embodiment, the pH of the anoltye and catholyte are individually about 2 or less. In yet another embodiment, the pH of the anoltye and catholyte are individually about 1.5 or less. The pH of the electroplating bath may be adjusted using additions of the acid or a basic compound. For example, sodium hydroxide and/or one or more of the above-mentioned acids may be used to adjust the pH of the bath.

The tin alloy electroplating bath (anolyte and/or catholyte) optionally contains one or more additives. Various additives either facilitate the electroplating process and/or improve the characteristics of the resultant tin alloy layer. Additives include brighteners, carriers, leveling agents, surfactants, wetting agents, reducing agents, promoters, antioxidants, and the like. In one embodiment, the tin alloy electroplating bath does not contain one or more of complexing agents and/or chelating agents.

In one embodiment, the tin alloy electroplating bath contains about 10 ppb or more and about 50 g/l or less of one or more additives. In another embodiment, the tin alloy electroplating bath contains about 100 ppb or more and about 20 g/l or less of one or more additives. In yet another embodiment, the tin alloy electroplating bath contains about 300 ppb or more and about 10 g/l or less of one or more additives.

Brighteners contribute to the ability of the tin alloy electroplating bath to provide bright tin alloy deposits on cathodes. Electroplating bath brighteners are generally described in U.S. Pat. Nos. 5,433,840; 5,431,803; 5,417,841; 5,403,465; 5,215,645; 5,174,886; 5,151,170; 5,145,572; 5,068,013; 5,024,736; 4,990,224; 4,954,226; 4,948,474; 4,897,165; 4,781,801; 4,673,467; 4,551,212; 4,540,473; 4,490,220; 4,430,173; 4,334,966; 4,242,181; and 2,424,887, which are hereby incorporated by reference in this regard.

Leveling agents promote the formation of a smooth surface of the electroplated tin alloy layer, even if the cathode surface on which the tin alloy layer is formed is not smooth. Examples of leveling agents include the condensation products of thiourea and aliphatic aldehydes; thiazolidinethiones; imidazolidinethiones; quaternized polyamines; and the like.

Wetting agents promote leveling and brightening, as well as promoting bath stability. Examples of wetting agent include polyoxyalkylated naphthols; ethylene oxide/polyglycol compounds; sulfonated wetting agents; carbowax type wetting agents; and the like.

Surfactants contribute to the overall stability of the bath and improve various properties in the resultant tin alloy layer. General examples of surfactants include one or more of a nonionic surfactant, cationic surfactant, anionic surfactant, and amphoteric surfactant. Specific examples of surfactants include nonionic polyoxyethylene surfactants; alkoxylated amine surfactants; ethylene oxide-fatty acid condensation products; polyalkoxylated glycols and phenols; betaines and sulfobetaines; amine ethoxylate surfactants; quaternary ammonium salts; pyridinium salts; imidazolinium salts; sulfated alkyl alcohols; sulfated lower ethoxylated alkyl alcohols; and the like.

The tin alloy plating system of the present invention contains at least one selective membrane, such as ionic and nonionic selective membranes. The dividers and/or bipolar membranes function as diffusion barriers. The selective membrane is positioned between the catholyte and anolyte. Selective membranes may permit the passage therethrough of certain ionic species while preventing the passage therethrough of other ionic species. Selective membranes alternatively may permit the passage therethrough of nonionic species while preventing the passage therethrough of ionic species. For example, the selective membrane may permit the flow of water therethrough, for instance osmotically, while preventing the passage of metal ions therethrough. One function of the selective membrane of the present invention is to prevent substantial amounts of metal cations from migrating from the catholyte to the anolyte.

In one embodiment, the selective membranes which can be utilized in the present invention can be selected from a wide variety of microporous diffusion barriers, screens, filters, diaphragms, etc., which contain pores of the desired size allow anions and/or water to migrate therethrough. The microporous dividers can be prepared from various materials including plastics such as polyethylene, polypropylene and Teflon, ceramics, etc. Microporous selective membranes such as nonionic dividers and nanoporous membranes can be used. Specific examples of commercially available microporous separators include: Celanese Celgard and Norton Zitex. Size selective membranes, such as a nanoporous and microporous membranes, and size selective anion selective membranes and size selective cation selective membranes, prevent substantial amounts of metal cations from passing therethrough but permit the passage therethrough of water.

In one embodiment, the selective membrane is ionic selective membrane such as an anion selective membrane or a cation selective membrane. Any anion selective membrane may be utilized including membranes used in processes for the desalination of brackish water. Preferably, anion selective membranes are selective with respect to the particular anions present in the cell (e.g., acid anion and metal salt anion). Preferably, cation selective membranes are size selective cation selective membranes that are selective with respect to the particular cations present in the cell based on relative size. The cation selective membranes used may be any of those which have been used in the electrochemical purification or recycling of chemical compounds. For example, the cation selective membranes typically include fluorinated membranes containing cation selective groups such as perfluorosulfonic acid and perfluorosulfonic and/perfluorocarboxylic acid, perfluorocarbon polymer membranes.

The preparation and structure of anionic membranes and cationic membranes are described in the chapter entitled "Membrane Technology" in Encyclopedia of Chemical Technology, Kirk-Othmer, Third Ed., Vol. 15, pp. 92–131, Wiley & Sons, New York, 1985. These pages are hereby incorporated by reference for their disclosure of various anionic membranes which may be useful in the systems and methods of the present invention.

Selective membranes are commercially available. General examples of selective membranes include those membranes under the trade designations Selemion™ from Asahi Glass; Nafion® from DuPont; Ultrex™ from Membranes International Inc.; and Ionac from Sybron Chemicals Inc.; and membranes from PCA GmbH. Among the anion selective membranes which may be utilized and which are commercially available are the following: AMFLON, Series 310, based on fluorinated polymer substituted with quaternary ammonium groups produced by American Machine and Foundry Company; IONAC MA 3148, MA 3236 and MA 3475, based on polymer substituted with quaternary ammonium derived from heterogenous polyvinylchloride produced by Ritter-Pfaulder Corp., Permutit Division; Tosflex IE-SF 34 or IE-SA 48 made by Tosoh Corp. which is a membrane designed to be stable in alkaline media; NEOSEPTA AMH, NEOSEPTA ACM, NEOSEPTA AFN or NEOSEPTA ACLE-SP from Tokuyama Soda Co.; and Selemion™ AMV and Selemion™ AAV from Asahi Glass. Among the cation selective membranes which may be utilized and which are commercially available are the following: those sold by the DuPont under the general trade designation Nafion® such as DuPont's Cationic Nafion® 423 and 902 membranes; styrenedivinyl benzene copolymer membranes containing cation selective groups such as sulfonate groups, carboxylate groups; Raipore Cationic R1010, (from Pall RAI), and NEOSEPTA CMH and NEOSEPTA CM1 membranes from Tokuyama Soda Co.

The temperature of the electroplating bath is maintained to promote the efficient plating of tin alloy on the cathode. In one embodiment, the temperature of the electroplating bath, during plating, is about 5° C. or more and about 90° C. or less. In another embodiment, the temperature of the electroplating bath is about 25° C. or more and about 70° C. or less. In yet another embodiment, the temperature of the electroplating bath is about 30° C. or more and about 60° C. or less.

Any anode, cathode, power source, bath container, agitator, etc. suitable for electroplating metal such as tin alloy on a cathode may be employed in the present invention. Any suitable source of power is connected to the electrodes, such as direct current, alternating current, pulsed current, periodic reverse current, or combinations thereof.

A current density is imposed from an energy source through the electrodes causing tin ions and at least one other metal ion from the catholyte to migrate towards and attach to the cathode forming a layer of tin alloy thereon. Due, in part, to the system layout of present invention in the tin alloy electroplating bath, a wide range of current densities may be employed. In one embodiment, current densities of about 1 ASF or more and about 1,000 ASF or less are employed. In another embodiment, current densities of about 10 ASF or more and about 500 ASF or less are employed. In yet another embodiment, current densities of about 20 ASF or more and about 400 ASF or less are employed.

The cathodes are any electrically conductive material that can accommodate tin alloy plating while resisting degradation by the acidic nature of the catholyte. The cathode substrates include metal structures and non-metal structures. Metal structures, or structures with a metal surface contain surfaces of one or more of aluminum, bismuth, cadmium, chromium, copper, gallium, germanium, gold, indium, iridium, iron, lead, magnesium, nickel, palladium, platinum, silver, tin, titanium, tungsten, zinc, and the like. Non-metal structures include plastics, circuit board prepregs (including materials such as glass, epoxy resins, polyimide resins, Kevlar®, Nylon®, Teflon®, etc.), metal oxides, and the like.

The anodes are electrically conductive materials that can deliver tin ions into solution, and in particular, into the anolyte. Accordingly, the anode contains at least tin, and optionally other materials. In a preferred embodiment, the anode is a working tin anode. There is an economic advantage associated with generation of tin ions from the working anodes. In particular, compared to providing tin ions from a liquid concentrate (tin salt), the cost of tin via an anode is a fraction of that from the liquid concentrate (such as about one-quarter of the cost or less including about one-eight of the cost). Solid working tin anodes are also advantageous in that they are markedly easier to handle, store, and transport, compared with liquid concentrates of tin salts.

The length of time that the cathode is in contact with the catholyte under a specified current density depends upon the desired thickness of the resultant tin alloy layer and the concentrations of the electroplating bath components. In one embodiment, the cathode is in contact with the catholyte (period of time from the when the tin alloy begins to form until the tin alloy is removed from the cathode) under a specified current density for a time of about 1 second or longer and about 60 minutes or shorter. In another embodiment, the cathode is in contact with the catholyte (under plating conditions) under a specified current density for a time of about 5 seconds or longer and about 30 minutes or shorter. In yet another embodiment, the cathode is in contact with the catholyte under a specified current density for a time of about 10 seconds or longer and about 10 minutes or shorter.

The conduit permits the one way flow of anolyte into the catholyte compartment, without passing through the selective membrane. Consequently, every chemical species present in the anolyte is introduced into the catholyte. The conduit may be comprised of tubing, piping, an overflow trough, or an aperture in the anolyte compartment that permits the one way flow of anolyte into the catholyte compartment. If appropriate, the conduit can be optionally equipped with one way valves or other structures to prevent the flow of catholyte into the anolyte compartment.

Most, if not all, of the tin ions in the anolyte (generally excepting the initial anolyte at the beginning of the tin alloy plating process) are provided by the tin containing anode. Since the conduit permits the flow of anolyte into the catholyte compartment, tin ions generated in situ by the anode are replenished or transferred to the catholyte. When a working tin containing anode is spent, a fresh tin containing anode may be provided to the anolyte compartment.

Generally speaking, the one way flow of anolyte into the catholyte compartment is induced by the passage of water from the catholyte compartment to anolyte compartment through the selective membrane thereby increasing the volume of anolyte in the anolyte compartment. To further facilitate flow of anolyte into the catholyte compartment, the conduit can be optionally equipped with a pump or similar functioning device.

The conduit or plating system may be equipped with a flow meter and/or a flow controller to measure and control the amount of anoltye that flows into the catholyte compartment. The flow meter and/or a flow controller may be connected to a computer/processor including a memory to facilitate measuring and controlling the amount of anoltye that flows into the catholyte compartment and/or for automated process control of the tin alloy plating method. The computer/processor may be further coupled to sensors in the anolyte and catholyte compartments to measure one or more of pH, species concentration, volume, and the like. The computer/processor may be coupled to control valves that permit introduction of additional water, metal, acid, and/or base, into either or both the anolyte and catholyte compartments.

While not wishing to be bound by any theory, it is believed that the selective membrane prevents the migration of metal ions into the anolyte, thereby preventing immersion deposition of alloy metals on the working tin containing anode, while the selective membrane permits-water migration into the anolyte. When the alloy metal is more noble than tin, a difference in standard potentials exists that can lead to immersion deposition of the alloy metal onto the working tin anode. However, since selective membrane prevents the migration of metal ions into the anolyte, immersion deposition is mitigated. Moreover, since the problem of immersion deposition is mitigated, additives such as complexing agents and chelating agents are no longer required to prevent or mitigate immersion deposition. When the electroplating bath is equipped with a conduit permitting flow of anolyte into the catholyte compartment, the flow of anolyte increases the concentration of tin ions in the catholyte, promoting efficient deposition of tin on the cathode.

Figure 2:
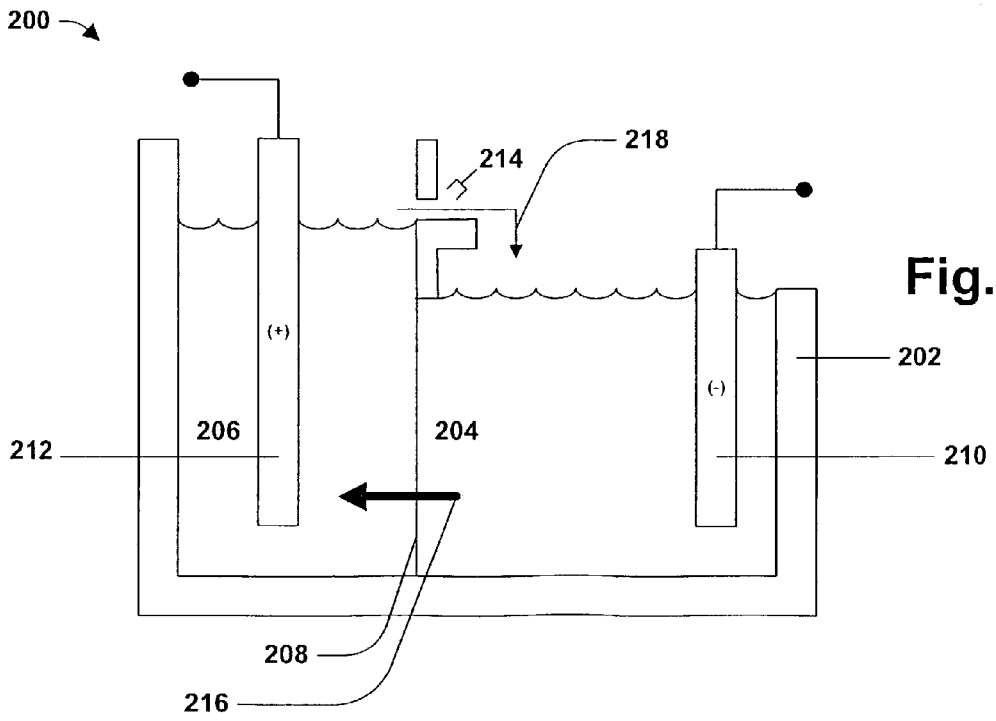
FIG. 2 illustrates a schematic diagram of another tin alloy electroplating system in accordance with one aspect of the present invention.

Referring to FIG. 2, another embodiment of a tin alloy plating system 200 includes an electrochemical cell 202 containing an anolyte compartment 206 and a catholyte compartment 204 separated by a selective membrane 208 (and this general arrangement may be repeated one or more times to provide electrochemical cells with a plurality of anolyte compartments 206, catholyte compartments 204, and selective membranes 208). A power source (not shown) may provide current to the electrochemical cell 202.

The anolyte compartment 206 contains an anode 212 and an aqueous anolyte and the catholyte compartment 204 contains a cathode 210 and an aqueous catholyte. The aqueous anolyte contains at least water, an acid, and ionic tin while the aqueous catholyte contains water, acid, one or more ionic alloy metals, and ionic tin. The electrochemical cell has a conduit 214 to permit the one way flow 218 of the aqueous anolyte into the catholyte compartment 204. Water may flow 216 from the aqueous catholyte into the anolyte compartment 206 through selective membrane 208. However, the selective membrane 208 prevents metal ions in general, and alloy metal ions in particular, from migrating from the catholyte to the anolyte compartment 206. Plating of a tin alloy occurs at the cathode 210.

In the electrochemical cell 202, water osmotically migrates through the selective membrane 208 from the side with lower ionic strength to the side with higher ionic strength (from the catholyte to the anolyte). In essence, the water migration is a natural attempt to bring the system to ionic equilibrium. As the tin ion concentration rises in the anolyte, the anolyte ionic strength increases. When the anolyte ionic strength is greater than the catholyte ionic strength, water migrates 216 through the selective membrane 208, increasing the solution volume of the anolyte in the anolyte compartment 206. Given sufficient ionic strength disparity, the water migration can cause enough volume increase in the anolyte to overflow 218 the anolyte compartment 206 through the conduit 214 and into the catholyte compartment 204. When proper attention is paid to the ionic balance, the overflow can be controlled such that high concentration tin ion is returned to the catholyte compartment 204 through overflow to develop a steady state tin metal concentration within the catholyte. Tin is replenished in the catholyte by the working tin containing anode 212.

In the electrochemical cell 202, over the side additions of one or more alloy metal salts or one or more ionic alloy metals may be made to the catholyte compartment 204 to retain a desirable ratio of ionic alloy metal to ionic tin in the catholyte to form the desired tin alloy. Over the side additions of one or more acids to the anolyte compartment 206 and/or the catholyte compartment 204 may also be made, especially to the anolyte to replenish what may be carried to the catholyte.

In one embodiment, the thickness of the resultant tin alloy layer electroplated, in accordance with the present invention, is about 0.1 micron or more and about 5,000 microns or less. In another embodiment, the thickness of the resultant tin alloy layer electroplated, in accordance with the present invention, is about 1 micron or more and about 1,000 microns or less.

The tin alloys formed in accordance with the present invention may or may not be high tin alloys. In one embodiment, tin alloys contain at least about 1% by weight tin and about 99% by weight or less of one or more alloy metals. High tin alloys contain at least about 70% by weight tin and about 30% by weight or less of one or more alloy metals. In another embodiment, high tin alloys formed in accordance with the present invention contain at least about 90% by weight tin and about 5% by weight or less of one or more alloy metals. In yet another embodiment, high tin alloys formed in accordance with the present invention contain at least about 95% by weight tin and about 3% by weight or less of one or more alloy metals. In still yet another embodiment, tin alloys formed in accordance with the present invention contain at least about 99% by weight tin and about 1% by weight or less of one or more alloy metals.

Regardless of whether or not the tin alloy is a high tin alloy, the tin alloys formed in accordance with the present invention do not contain substantial amounts of lead. For example, the tin alloys formed in accordance with the present invention contain less than about 0.1% by weight lead. In another embodiment, the tin alloys formed in accordance with the present invention contain less than about 0.01% by weight lead. In yet another embodiment, the tin alloys formed in accordance with the present invention contain less than about 0.001% by weight lead. In still yet another embodiment, the tin alloys formed in accordance with the present invention contain no detectable amounts of lead. Lead present in the tin alloys is likely attributable to impurities in the anode material and/or the metal salts.

Specific examples of high tin alloys that may be formed in accordance with the present invention include: a tin alloy containing from about 95% to about 99% by weight tin and from about 1% to about 5% by weight silver; a tin alloy containing from about 90% to about 99.9% by weight tin and from about 0.1% to about 10% by weight bismuth; a tin alloy containing from about 95% to about 99.9% by weight tin and from about 0.1% to about 5% by weight copper; a tin alloy containing from about 70% to about 90% by weight tin and from about 10% to about 30% by weight zinc; a tin alloy-containing from about 94% to about 98.9% by weight tin, from about 0.1% to about 1% by weight bismuth, and from about 1% to about 5% by weight silver; and a tin alloy containing from about 90% to about 98% by weight tin, from about 1% to about 5% by weight copper, and from about 1% to about 5% by weight silver.

The resultant tin alloy layer electroplated in accordance with the present invention has many desirable characteristics including one or more of lack of latent whiskering, relatively high tin content, lead free alloys, excellent solderability, excellent lubricity, excellent electrical conductivity, corrosion resistance, uniform thickness, excellent leveling, excellent ductility, lack of pinholes, environmentally friendly processing, and controllable thickness.

Uniform thickness means uniform in two senses. First, a uniformly thick tin alloy layer results when electroplating a smooth or curvilinear surface cathode and the tin alloy layer has substantially the same thickness in any location after removal from the surface of the cathode. This uniformly thick tin alloy layer is smooth and flat when the surface of the cathode is smooth while the uniformly thick tin alloy layer may have an uneven surface mimicking the uneven contours of the underlying cathode surface. Second, a uniformly thick tin alloy layer results when electroplating an uneven cathode surface so that the resultant tin alloy layer appears smooth and the tin alloy layer has substantially the same thickness within locally smooth regions on the surface of the cathode. This second sense also refers to excellent leveling.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A system for plating a tin alloy, comprising:

an electrochemical cell comprising an anolyte compartment and a catholyte compartment separated by a selective membrane, and a conduit to permit one way flow of anolyte to the catholyte compartment;

the anolyte compartment comprising an anode and anolyte comprising water, methane sulfonic acid, and stannous ion; and the catholyte compartment comprising a cathode and catholyte comprising water, methane sulfonic acid, an ionic alloy metal, and stannous ion, with the proviso that the tin alloy does not comprise substantial amounts of lead, wherein the selective membrane prevents substantial amounts of stannous ion from migrating from the catholyte to the anolyte.

2. The system of claim 1, wherein the anode comprises tin.

3. The system of claim 1, wherein the ionic alloy metal comprises at least one metal ion selected from the group of bismuth, copper, silver, zinc, and indium.

4. The system of claim 1, wherein the anolyte or catholyte further comprises an alkanol sulfonic acid represented by Formula II:

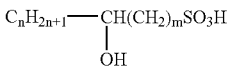

(II)

wherein n is from about 0 to about 10, m is from about 1 to about 11 and the sum of m+n is up to about 12.

5. The system of claim 1, wherein the anolyte or catholyte further comprises at least one selected from the group consisting of sulfuric acid, trifluoroacetic acid, phosphoric acid, polyphosphoric acid, fluoboric acid, hydrochloric acid, acetic acid, alkane sulfonic acids, and alkanol sulfonic acids.

6. The system of claim 1, wherein the conduit comprises one selected from the group consisting of tubing, piping, and an overflow trough.

7. The system of claim 1, wherein the conduit comprises one selected from the group consisting of tubing, piping, an overflow trough, and an aperture in the anolyte compartment.

8. The system of claim 1, wherein the tin alloy comprises at least about 1% by weight tin and about 99% by weight or less of at least one selected from the group consisting of bismuth, copper, silver, zinc, and indium.

9. The system of claim 1, wherein the tin alloy comprises a high tin alloy comprising at least about 70% by weight tin and about 30% by weight or less of at least one selected from the group consisting of bismuth, copper, silver, zinc, and indium.

10. The system of claim 1, wherein the selective membrane comprises an anionic selective membrane or a cation selective membrane.

11. A system for plating a tin alloy, comprising:

an electrochemical cell comprising an anolyte compartment and a catholyte compartment separated by a selective membrane, and a conduit to permit one way flow of anolyte to the catholyte compartment;

the anolyte compartment comprising an anode and anolyte comprising water, an acid, and stannous ion; and the catholyte compartment comprising a cathode and catholyte comprising water, acid, an ionic alloy metal, and stannous ion, wherein the acid comprises at least one selected from the group consisting of methane sulfonic acid and an alkanol sulfonic acid represented by Formula II:

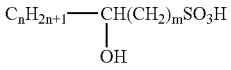

(II)

wherein n is from about 0 to about 10, m is from about 1 to about 11 and the sum of m+n is up to about 12, with the proviso that the tin alloy does not comprise substantial amounts of lead, and wherein the selective membrane prevents substantial amounts of stannous ion from migrating from the catholyte to the anolyte.

12. A method of electroplating a tin alloy using the system of claim 11, comprising:

providing an electroplating bath comprising an anolyte compartment and a catholyte compartment separated by a selective membrane; the anolyte compartment comprising an anode and anolyte comprising water, an acid, and stannous ion; the catholyte compartment comprising a cathode and catholyte comprising water, acid, at least one ionic alloy metal, and stannous ion; the selective membrane preventing substantial amounts of stannous ion from migrating from the catholyte to the anolyte;

applying a current to the electroplating bath whereby a tin alloy forms on the cathode.

13. The method of claim 12, wherein the selective membrane prevents the ionic alloy metal of the catholyte from entering the anolyte compartment.

14. The method of claim 12, wherein the anolyte and catholyte each independently have a pH of the of about 3 or less and a current density of about 1 ASF or more and about 1,000 ASF or less is applied to the electroplating bath.

15. The method of claim 12, wherein the electroplating bath has a conduit to permit one way flow of anolyte to the catholyte compartment.

16. The method of claim 12, wherein the anode comprises tin and the ionic alloy metal comprises at least one metal ion selected from the group of bismuth, copper, silver, zinc, and indium.

17. The method of claim 12, wherein the tin alloy comprises tin and at least two selected from the group consisting of bismuth, copper, silver, zinc, and indium.

18. A method of forming a lead free tin alloy using the system of claim 1, comprising providing an electroplating bath comprising an anolyte compartment and a catholyte compartment separated by a selective membrane and a conduit; the anolyte compartment comprising an anode and an anolyte comprising water, an acid, and stannous ion; the catholyte compartment comprising a cathode and a catholyte comprising water, acid, at least one ionic alloy metal, and stannous ion; the conduit permitting one way flow of anolyte to the catholyte compartment; and applying a current to the electroplating bath whereby a lead free tin alloy forms on the cathode.

19. The method of claim 18, wherein the anode comprises tin.

20. The method of claim 18, further comprising adding at least one ionic alloy metal to the catholyte compartment.

21. The method of claim 18, further comprising adding at least one acid to the anolyte compartment.

22. The method of claim 18, wherein the conduit comprises one selected from the group consisting of tubing, piping, an overflow trough, and an aperture in the anolyte compartment.

23. The method of claim 18, wherein the selective membrane comprises an ionic selective membrane or a size selective membrane.

24. A system for plating a tin alloy, comprising:

an electrochemical cell comprising an anolyte compartment and a catholyte compartment separated by a selective membrane, and a conduit to permit one way flow of anolyte to the catholyte compartment;

the anolyte compartment comprising an anode and anolyte comprising water, an acid, and stannous ion; and the catholyte compartment comprising a cathode and catholyte comprising water, acid, an ionic alloy metal, and stannous ion, with the proviso that the tin alloy does not comprise substantial amounts of lead, wherein the selective membrane prevents substantial amounts of stannous ion from migrating from the catholyte to the anolyte.

25. The system of claim 24, wherein the conduit comprises one selected from the group consisting of tubing, piping, an overflow trough, and an aperture in the anolyte compartment.

26. A method of electroplating a tin alloy using the system of claim 24, comprising:

providing an electroplating bath comprising an anolyte compartment and a catholyte compartment separated by a selective membrane; the anolyte compartment comprising an anode and anolyte comprising water, an acid, and stannous ion; the catholyte compartment comprising a cathode and catholyte comprising water, acid, at least one ionic alloy metal, and stannous ion;

applying a current to the electroplating bath whereby a tin alloy forms on the cathode.

27. The method of claim 26, wherein the acid comprises at least one selected from the group consisting of sulfuric acid, trifluoroacetic acid, phosphoric acid, polyphosphoric acid, fluoboric acid, hydrochloric acid, acetic acid, alkane sulfonic acids, and alkanol sulfonic acids.

28. A system for plating a tin alloy, comprising:

an electrochemical cell comprising an anolyte compartment and a catholyte compartment separated by a selective membrane, and a conduit to permit one way flow of anolyte to the catholyte compartment;

the anolyte compartment comprising an anode and anolyte comprising water, an acid, and stannous ion; and the catholyte compartment comprising a cathode and catholyte comprising water, acid, an ionic alloy metal, and stannous ion, wherein the tin alloy comprises a high tin alloy comprising at least about 70% by weight tin and about 30% by weight or less of at least one selected from the group consisting of bismuth, copper, silver, zinc, and indium, with the proviso that the tin alloy does not comprise substantial amounts of lead, and wherein the selective membrane prevents substantial amounts of stannous ion from migrating from the catholyte to the anolyte.

29. The system of claim 28, wherein the anode comprises tin.

30. A method of electroplating a tin alloy using the system of claim 28, comprising:

providing an electroplating bath comprising an anolyte compartment and a catholyte compartment separated by a selective membrane; the anolyte compartment comprising an anode and anolyte comprising water, an acid, and stannous ion; the catholyte compartment comprising a cathode and catholyte comprising water, acid, at least one ionic alloy metal, and stannous ion;

applying a current to the electroplating bath whereby a tin alloy forms on the cathode.

* * * * *